United States Patent [19]

Beck

[11] Patent Number: 4,459,764

[45] Date of Patent: Jul. 17, 1984

[54] SHOE HEEL GUARD

[75] Inventor: Michael S. Beck, Lake Worth, Fla.

[73] Assignee: Security Comfort Co. Inc., Lake Worth, Fla.

[21] Appl. No.: 484,664

[22] Filed: Apr. 13, 1983

[51] Int. Cl.[3] ..... A43B 13/22

[52] U.S. Cl. ..... 36/72 B

[58] Field of Search ..... 36/72 B; 24/255 SL, 24/255 BS

[56] References Cited

U.S. PATENT DOCUMENTS

| | | | |
|---|---|---|---|
| 268,376 | 3/1883 | Scharf | D2/314 |
| 1,571,466 | 2/1925 | Barthes | 36/72 B |
| 1,585,856 | 9/1924 | Headley | 36/72 B |
| 1,701,018 | 2/1929 | Smart | 36/72 B |
| 1,770,261 | 6/1929 | Barthes | 36/72 B |
| 1,955,159 | 4/1934 | Winget | 36/72 B |
| 2,894,339 | 11/1958 | Shapiro | 36/72 B |
| 2,988,830 | 12/1958 | Zacks | 36/72 B |
| 3,239,953 | 3/1966 | Norton | 36/72 B |
| 3,851,412 | 12/1974 | Voegele et al. | 36/72 B |
| 3,982,307 | 9/1976 | Smith et al. | 24/255 SL |
| 3,983,641 | 10/1976 | Wright | 36/72 B |

*Primary Examiner*—Henry Jaudon
*Assistant Examiner*—Tracy G. Graveline
*Attorney, Agent, or Firm*—Blum, Kaplan, Friedman, Silberman & Beran

[57] ABSTRACT

A shoe heel guard for protecting the rear and heel portions of a shoe on a foot of a driver of a vehicle. The shoe heel guard includes a frame having a generally U-shaped cross-section. The frame is sized to provide an interference fit on the back of the shoe. The frame includes a rounded rear portion and opposing side portions which define an open area therebetween in which the back of shoe is inserted. The frame includes a lower peripheral edge which extends inwardly from the bottom of the rounded rear portion against which the heel of the shoe rests, the lower peripheral edge having a slot formed therein to enhance the interference fit of the guard with the shoe.

14 Claims, 3 Drawing Figures

SHOE HEEL GUARD

BACKGROUND OF THE INVENTION

The present invention is directed to a shoe heel guard and, in particular, to a shoe heel guard for protecting the rear and heel portions of a shoe on the foot of a driver of a vehicle which would otherwise become marred, scuffed and soiled while utilizing the foot to operate the accelerator, brake and clutch pedals of a vehicle.

In driving a vehicle such as an automobile, the driver generally utilizes his right foot to operate the accelerator and brake pedals. Where the automobile has a manual transmission, the left foot is used to operate the clutch pedal. The back rounded portion of the shoe and the heel of the shoe rest against the floor of the vehicle at the base of and below the accelerator and brake pedals. This resting of the shoe and movement between the accelerator pedal and brake pedal causes the shoe to become scuffed and dirty in appearance due, in part, to the dirt which accumulates on the floor of the vehicle. In addition, the rubbing causes the shoe polish on the shoe to lose its brilliance.

Several proposals for shoe heel guards have appeared over the years in the art. For example, U.S. Pat. No. 3,851,412 discloses a heel protector cover for protecting the shoe of a driver. However, the heel protector cover construction of U.S. Pat. No. 3,851,412 requires the use of a spring steel band affixed to the heel protector cover to provide the resilience necessary to insure a snug friction grip with the shoe. In addition, such a heel protector cover is not readily adaptable to different size shoes and is difficult to engage and remove from the shoe. Thus, the heel protector cover construction of U.S. Pat. No. 3,851,412 proves less than completely satisfactory.

Accordingly, it is desired to provide an improved shoe heel guard which may be molded from any desired molding material such as thermoplastic resins while having a construction which permits facile engagement and removal on the shoe and which provides the desired degree of interference fit therebetween.

SUMMARY OF THE INVENTION

Generally speaking, in accordance with the present invention, a shoe heel guard for protecting the back and heel portions of a shoe on the foot of a driver of a vehicle is provided. The shoe heel guard includes a frame having a generally U-shaped configuration in cross-section. The frame is sized to provide an interference fit on the back of a shoe when engaged thereto. The frame includes a rounded rear portion and opposing side portions defining an open area therebetween in which the back and heel of a shoe are inserted. The frame includes a lower peripheral edge which extends inwardly from the bottom of the rounded rear portion of the shoe heel guard against which the bottom of the heel of the shoe rests. The lower peripheral edge includes a slot formed therein to enhance the interference fit of the guard with the shoe.

In a preferred embodiment, the shoe heel guard is integrally molded from a thermoplastic resin such as a styrene and includes raised ribs on the outer opposing side portions thereof which facilitate placement and removal of the shoe heel guard on the shoe and positioning of the shoe heel guard on the shoe.

Accordingly, it is an object of the present invention to provide an improved shoe heel guard.

Another object of the present invention is to provide an improved shoe heel guard which can be inexpensively molded.

A further object of the present invention is to provide an improved shoe heel guard which is constructed to fit snuggly on different size shoes of a wearer and which is constructed to permit easy positioning and removal of the shoe heel guard.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
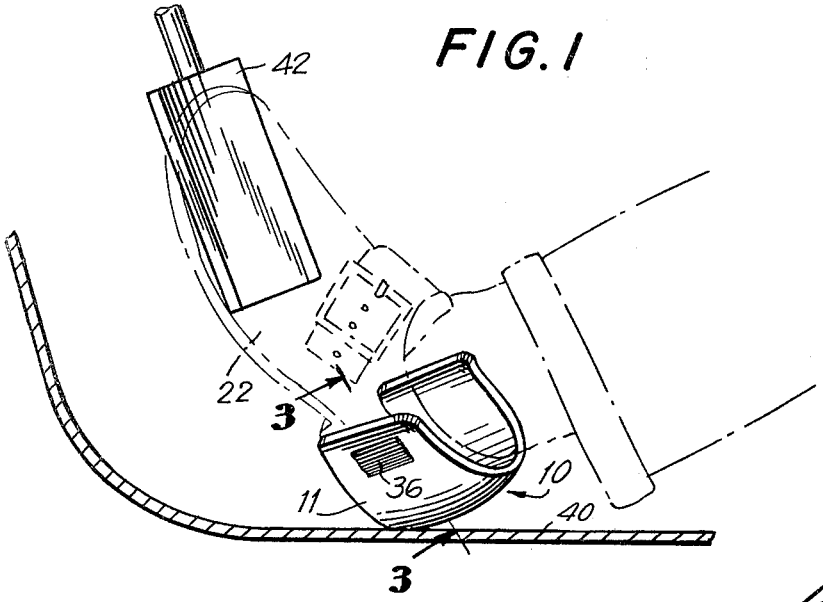
FIG. 1 is a perspective view of a shoe heel guard constructed in accordance with a preferred embodiment of the present invention, shown attached to a shoe, depicted in phantom, of a driver of a vehicle.
Figure 2:
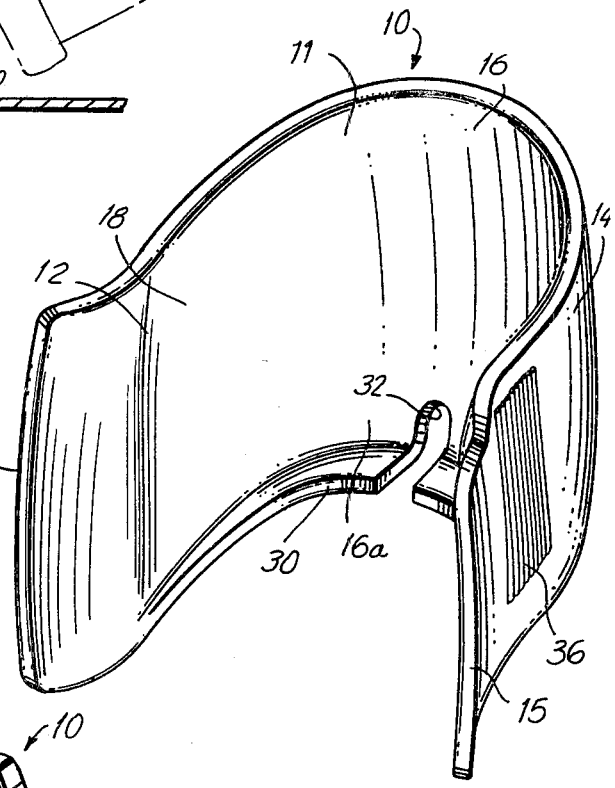
FIG. 2 is an enlarged perspective view of the shoe heel guard depicted in FIG. 1.
Figure 3:
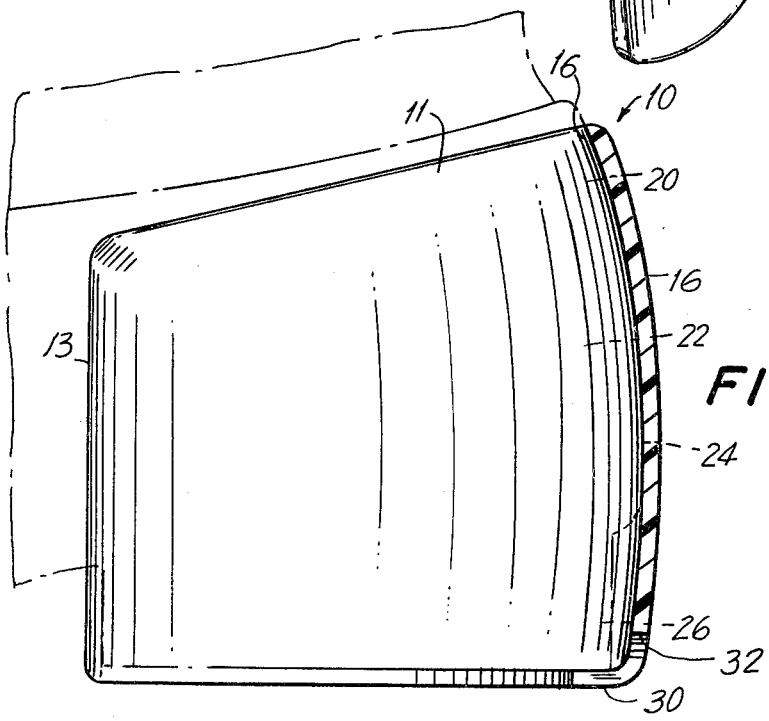
FIG. 3 is an enlarged sectional view taken along line 3—3 of FIG. 1.

Reference is made to FIGS. 1 through 3 which depict a shoe heel guard, generally indicated at 10, constructed in accordance with a preferred embodiment of the present invention. Shoe heel guard 10 includes a frame 11 which is generally U-shaped in cross-section. Frame 11 includes opposing side portions 12 and 14 and a rounded rear substantially vertical wall portion 16.

As best depicted in FIGS. 1 and 3, shoe heel guard 10 is adapted to be fitted over the back 20 of a shoe 22. In order to facilitate positioning of shoe heel guard 10 on back 20 of shoe 22, ends 13 and 15 of side portions 12 and 14, respectively, are flared outwardly away from open area 18 defined between side portions 12 and 14. When in position on shoe 22, rounded portion 16 of shoe heel guard 10 will rest against the rounded back portion 24 of shoe 22 while side portions 12 and 14 will rest against the sides of shoe 22 adjacent heel 26 thereof.

In order to provide complete protection, frame 11 includes a lower peripheral wall or ledge 30 which extends inwardly from bottom portion **16*a* of rounded substantially vertical wall portion 16. Wall 30 extends along side portions 12 and 14 and is of decreasing width towards ends 13 and 15 so as to blend therein towards the ends thereof. Lower peripheral wall 30 will rest against and protect the marginal portion of heel 26 as best depicted in FIG. 3**.

An opening or slot 32 is formed in lower peripheral wall 30 and extends into rounded rear portion 16. Slot 32 permits side walls 12 and 14 to move apart when shoe heel guard 10 is positioned on shoe 22 while providing the necessary interference fit to prevent inadvertent removal and slipping thereof. Slot 32 also permits a better and more snug interference fit to be created between shoe heel guard 10 and heel 26 of shoe 22.

The outer surfaces of side walls 12 and 14 include a roughened surface such as raised ribs 36 which permit shoe heel guard 10 to be properly gripped by a wearer's hand to facilitate engagement and removal of the shoe heel guard from the rear of the shoe and the positioning of the shoe heel guard on the shoe.

Shoe heel guard 10 is preferably molded from a thermoplastic material such as styrene. This permits easy, quick and inexpensive manufacture of shoe heel guard 10.

When in position on shoe 22 as best depicted in FIG. 1, shoe heel guard 10 provides protection to the rear and heel portions of shoe 22 when shoe 22 rests against the floor 40 of an automobile while operating the pedals of a vehicle such as pedal 42 depicted in FIG. 1. Shoe heel guard 10 prevents marring, soiling and scuffing of the portion of shoe 22 which would otherwise rest against floor 40 of the vehicle.

It is noted that where a vehicle includes a clutch pedal operated by the other foot of a driver, a separate shoe heel guard may be provided for both shoes to protect both against soiling.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A shoe heel guard for protecting the back and heel portions of a shoe on a foot of a driver of a vehicle comprising a frame having a generally U-shaped configuration in cross-section, said frame being sized to provide an interference fit on the back of said shoe when engaged therewith, said frame having a rounded rear portion including a substantially vertical wall portion and opposing side portions defining an open area therebetween in which said back of said shoe is engagably inserted, said frame having a lower peripheral edge which extends inwardly from the bottom of said rounded rear portion against which the bottom surface of the heel of said shoe is engaged, said lower peripheral edge having a slot formed therein which extends partially into said rounded substantially vertical wall portion of said frame to enhance the interference fit of the guard with the shoe.

2. The shoe heel guard as claimed in claim 1, wherein said side portions each include an end, said ends being flared away from said open area.

3. The shoe heel guard as claimed in claim 1, wherein said side portions each include an outer side and an inner side, said outer sides including gripping means for enhancing manual gripping of said shoe heel guard.

4. The shoe heel guard as claimed in claim 3, wherein said gripping means includes raised ribs.

5. The shoe heel guard as claimed in claim 4, wherein said raised ribs extend transversely along said side portions.

6. The shoe heel guard as claimed in claim 5, wherein said shoe heel guard is molded from a thermoplastic material.

7. The shoe heel guard as claimed in claim 1, wherein said shoe heel guard is molded from a thermoplastic material.

8. The shoe heel guard as claimed in claim 7, wherein said side portions each include an outer side and an inner side, said outer sides including gripping means for enhancing manual gripping of said shoe heel guard.

9. The shoe heel guard as claimed in claim 8, wherein said gripping means includes raised ribs.

10. The shoe heel guard as claimed in claim 9, wherein said raised ribs extend transversely along said side portions.

11. The shoe heel guard as claimed in claim 10, wherein said shoe heel guard is molded from a thermoplastic material.

12. The shoe heel guard as claimed in claim 11, wherein said thermoplastic material is styrene.

13. A shoe heel guard for protecting the rear and heel portion of a shoe of a driver of a vehicle comprising a generally U-shaped frame integrally molded from a thermoplastic material, said frame including a rounded rear substantially vertical wall portion and opposing side walls defining therebetween an open area in which the rear and heel of a shoe are inserted, said opposing side walls being spaced to provide an interference fit with said shoe, said frame further including a peripheral ledge which extends into said open area from said rounded rear portion, said peripheral ledge including a slot formed therein which extends into said rounded rear substantially vertical wall portion, said side walls including outer surfaces, said outer surfaces of said side walls including raised ribs.

14. The shoe heel guard as claimed in claim 13, wherein the ends of said side walls are flared away from said open area.

* * * * *